United States Patent [19]

Bass et al.

[11] 4,075,955

[45] Feb. 28, 1978

[54] MACHINE FOR NEEDLEPOINT OR THE LIKE

[75] Inventors: Sidney Bass, Los Angeles; Raymond Marie St. Pierre, Hawthorne, both of Calif.

[73] Assignee: Mattel, Inc., Hawthorne, Calif.

[21] Appl. No.: 757,870

[22] Filed: Jan. 10, 1977

[51] Int. Cl.[2] ..... D05C 15/04

[52] U.S. Cl. ..... 112/79 R; 112/169; 112/206

[58] Field of Search ..... 112/79 R, 79 A, 79.5, 112/80, 79 FF, 78, 2, 7, 9, 98, 169, 206; 428/85

[56] References Cited

U.S. PATENT DOCUMENTS

| | | | |
|---|---|---|---|
| 82,904 | 10/1868 | Waring | 112/79 R |
| 320,339 | 6/1885 | Dikeman | 112/79 R |
| 438,427 | 10/1890 | Rehfuss | 112/79 R |
| 593,207 | 11/1897 | Groebli | 112/79 R X |
| 650,990 | 6/1900 | Rice | 112/9 |
| 1,757,795 | 5/1930 | Dahlen | 112/79 R |
| 1,786,481 | 12/1930 | Curioni | 112/79 R |
| 1,788,340 | 1/1931 | Smalley et al. | 112/79 R |
| 1,924,715 | 8/1933 | Farrell | 112/79 R |
| 1,960,100 | 5/1934 | Doubler | 112/79 R |
| 2,018,456 | 10/1935 | Jonas | 112/98 X |
| 2,595,585 | 5/1952 | Kline | 112/79 R |
| 2,635,567 | 4/1953 | Drake | 112/80 |
| 2,753,821 | 7/1956 | Sigoda | 112/98 |
| 2,810,471 | 10/1957 | Shattuck | 112/79 A X |
| 2,954,749 | 10/1960 | Koppelman | 112/79 R |

*Primary Examiner*—H. Hampton Hunter
*Attorney, Agent, or Firm*—John G. Mesaros; Stephen L. King; Max E. Shirk

[57] ABSTRACT

A machine for performing needlepoint or the like wherein successive loops of a single strand of yarn or the like are inserted through fabric, the machine including a carriage mounted for slidable movement in a given direction, the carriage having an indexable open framework roller mounted thereon, the roller being adapted to support a fabric for receiving the yarn. First and second members are pivotally mounted about a common axis within the machine, each of the members having arm portions extending toward the roller and adapted for insertion through the fabric carried thereby. The arm of the first member is configured in the shape of a needle having an eye adapted to receive the yarn therethrough, the needle arm being channel-shaped in cross section for selectively receiving the arm of the other member in abutting sliding relation, the free end of the arm of the second member being notched. A double-faced cam disc is interposed between the first and second members, the disc being rotatable by a hand crank and having guideways formed in opposing surfaces for matingly coacting with cam follower projections on each of the first and second members. The cam guideways are configured so that upon rotation of the crank the needle with the yarn is inserted through the fabric, the notched portion of the other arm slidably engages the needle arm while so positioned to retain the loop within the fabric, the needle arm is withdrawn from the fabric, the other arm is moved laterally while engaging the fabric to increment the roller, the needle arm then inserts another loop of yarn, and the notched arm is then withdrawn to thereby continuously loop a single strand of yarn within the fabric.

18 Claims, 13 Drawing Figures

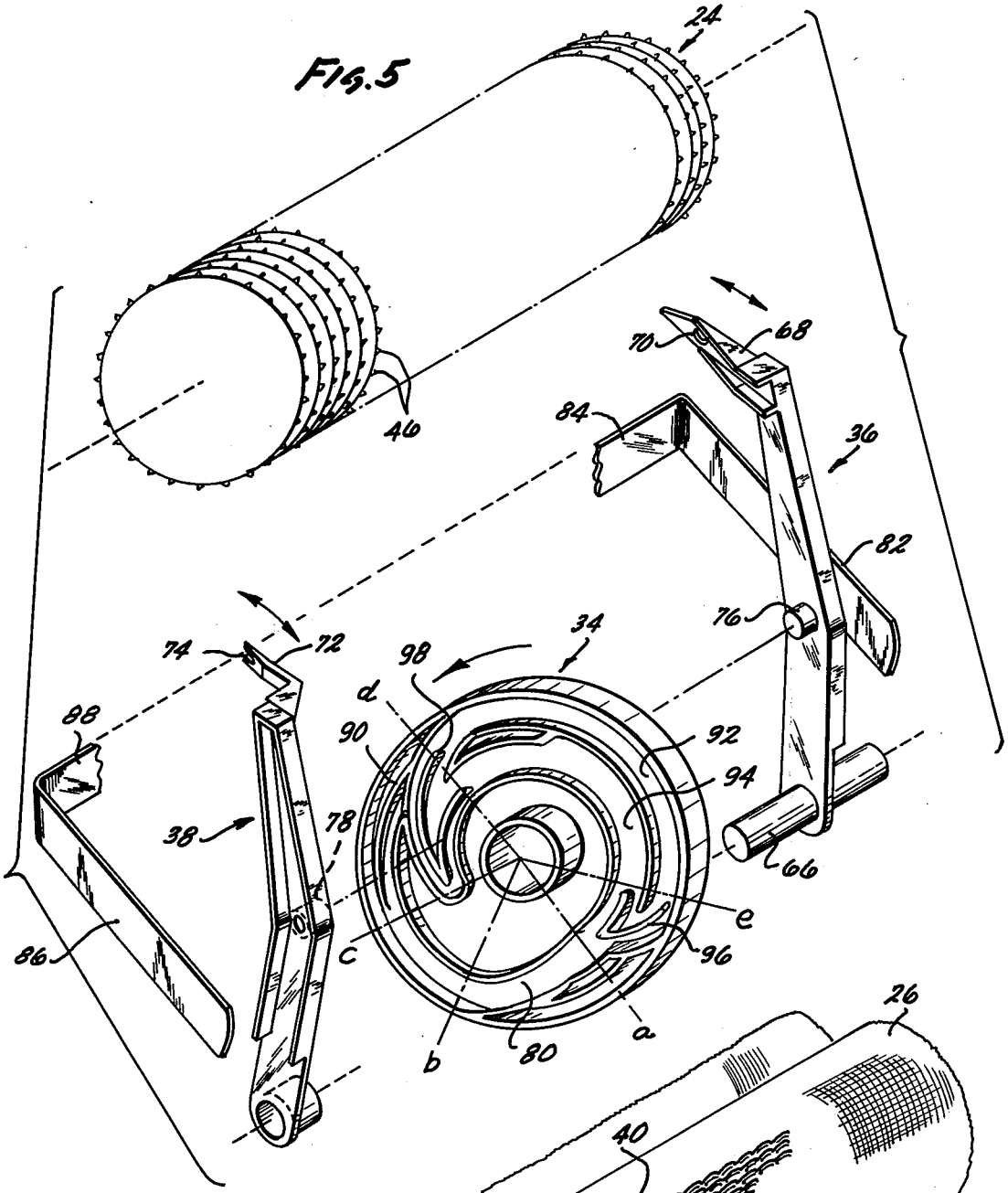
FIG. 5
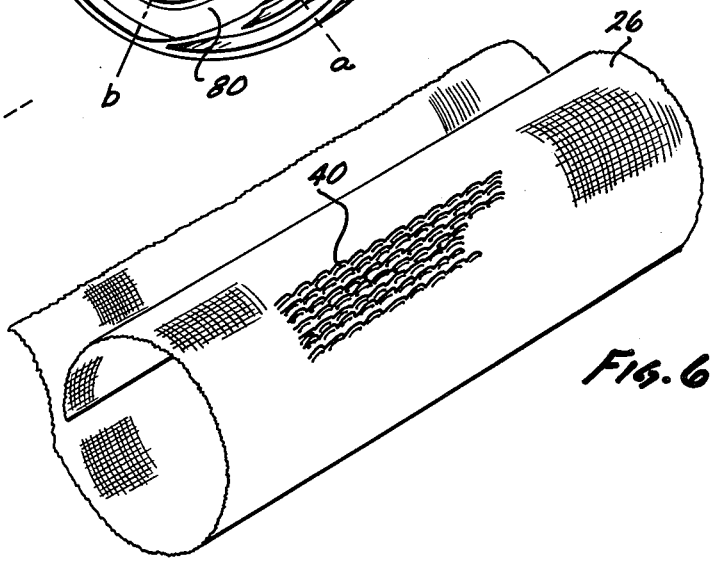
FIG. 6
FIG. 7
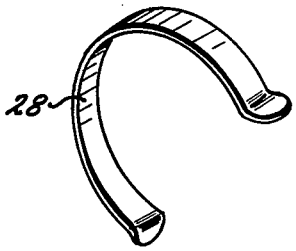

MACHINE FOR NEEDLEPOINT OR THE LIKE

BACKGROUND OF THE INVENTION

The background of the invention will be discussed in two parts:

1. Field of the Invention

This invention relates to a machine for performing needlepoint or carpet looping or the like wherein a single strand of yarn or cord-like material is repeatedly inserted in a fabric to form successive loops retained by the fabric, the selection of different colors of yarn creating patterns in the fabric.

2. Description of the Prior Art

Various hobbies have become increasingly popular, such hobbies including knitting, crocheting, needlepoint, carpet looping or the like. Most of these hobbies require a certain degree of manual dexterity which is not generally found in children. In some of these hobbies aids have been devised, but generally such aids have been aimed at the sophisticated enthusiast with the aids likewise requiring a certain degree of manual dexterity for full appreciation of the aid.

In order to enable a child to appreciate the creation of articles from yarn or other cord-like materials, any mechanism devised must be simple in operation, relatively uncomplicated, and required a minimum of manual dexterity for the ultimate appreciation of the device.

A typical hand implement for making hooked fabrics is shown in U.S. Pat. No. 2,635,567 issued Apr. 21, 1953 to E. P. Drake, the implement having a reversible hollow feed needle and a looper needle arranged to reciprocate within the hollow feed needle, the implement being held in one hand with the other hand being utilized to operate a crank to actuate the mechanism. The implement, being hand-held and hand-operated must be guided along fabric to achieve the desired pattern, thus requiring a level of manual dexterity not generally found in children.

There are, of course, commercial and industrial machines which perform such operations and some of the prior art relating thereto is set forth in a separate communication to the Patent Office by way of illustration.

It is accordingly an object of this invention to provide a new and improved machine for performing a needlepoint or carpet looping operation.

It is another object of this invention to provide a new and improved needlepoint machine wherein the fabric is carried past the needle.

It is still another object of this invention to provide a new and improved needlepoint machine simple in operation and uncomplicated in construction to permit children to create crafted fabrics with yarn patterns thereon.

SUMMARY OF THE INVENTION

The foregoing and other objects of the invention are accomplished by providing a machine for performing needlepoint or the like wherein successive loops of a single strand of yarn or other cord-like material is inserted through a fabric carried by an indexable roller mounted in a carriage slidably mounted on the machine for movement in a given direction. First and second inverted generally L-shaped members are pivotally mounted about a common axis at the free end of the long arms thereof, the short arms being in parallel relation extending toward the fabric and adapted for selective insertion through the fabric. The arm of the first member is configured in the shape of a needle having an eye adapted to receive the yarn therethrough, the needle arm being channel-shaped in cross section for selectively receiving the short arm of the second member in abutting sliding relation, the free end of the arm of the second member being notched to releasably receive the yarn. A double-faced cam disc is interposed between the members and is rotatable by a hand crank, the disc having guideways formed in opposing surfaces for matingly coacting with cam follower projections on each of the first and second members. The cam guideways are configured so that upon rotation of the hand crank, the needle arm inserts the yarn through the fabric, the notched portion of the other arm slidably engages the needle arm while so positioned to retain the loop within the fabric, the needle arm is withdrawn from the fabric, the other arm is moved laterally while engaging the fabric to increment the carriage, the needle arm then inserts another loop of yarn, and the notched arm is then withdrawn to thereby continuously loop a single strand of yarn within the fabric upon rotation of the hand crank.

Other objects, features and advantages of the invention will become apparent upon a reading of the specification when taken in conjunction with the drawings in which like referenced numerals refer to like elements in the several views.

BRIEF DESCRIPTION OF THE DRAWINGS

FIG. 5 is an exploded perspective view of the main working components of the machine of FIG. 1;

FIG. 6 is a perspective view showing a partially looped fabric illustrating the position thereof mounted on the roller of the machine;

FIG. 7 is a perspective view of a fabric retaining clip;

DESCRIPTION OF THE PREFERRED EMBODIMENT

In needlepoint or carpet looping, regardless of how performed, the requirements are generally the same, these being that the fabric selected must be a mesh fabric or an open weave fabric, with the openings therein being able to receive loops of the particular size of yarn or other cord-like material being employed. The yarn is inserted by use of a needle having an eye adjacent the point thereof, and desirably the depth of penetration of the yarn through the fabric is a uniformed predetermined distance. The needle is then withdrawn with the loop being retained and the eye of the needle sliding over the yarn a predetermined length to effect a subsequent penetration by the needle a given stitch width from the previous insertion. Adjacent rows of stitching may be of the same or different colors of the same or different overall lengths to thereby create an overall pattern on the fabric by generating many rows in a pre-designed format.

Figure 2:
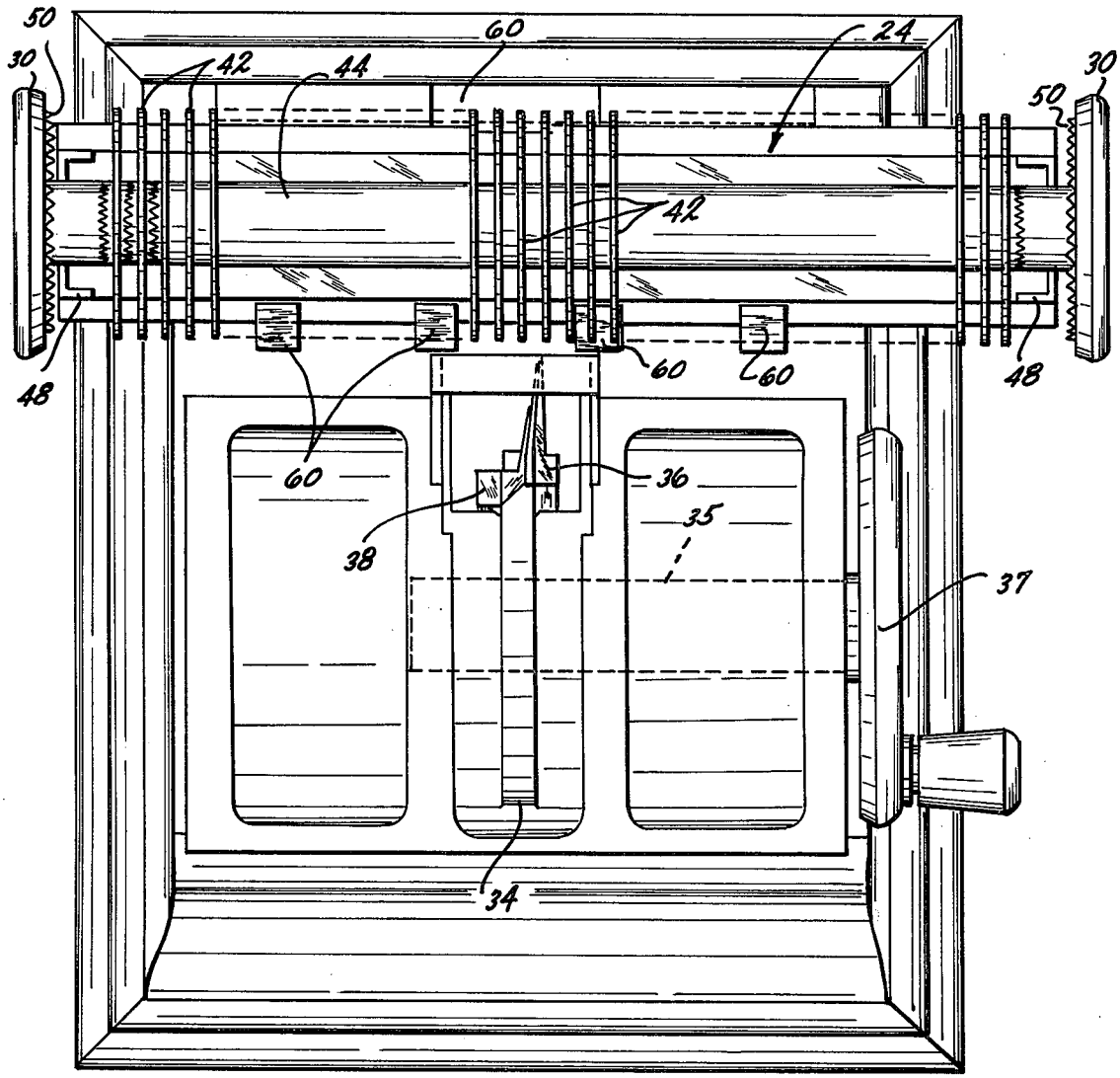
FIG. 2 is a plan view of the machine of FIG. 1.
Figure 1:
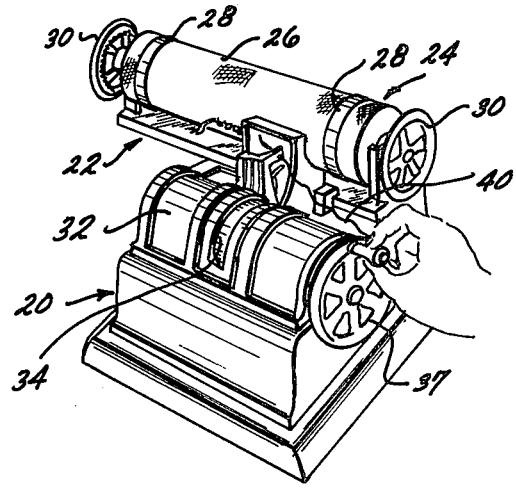
FIG. 1 is a perspective view of the needlepoint machine according to the invention.

Referring now to the drawings and particularly to FIGS. 1 and 2, there is shown a machine for accomplishing the sequence, the machine including a housing 20 having slidably mounted on a rear surface thereof a carriage 22 with an open framework roller 24 rotatably received thereon, the roller 24 being adapted to receive about the periphery thereof a suitable fabric 26 secured at opposite ends by suitable fabric retaining clips 28. The roller 24, similar to the roller of a conventional typewriter is rotatable or indexable by means of handles 30 at opposite ends of the roller 24.

The central portion 32 of housing 20 has an inverted arcuate hollow configuration adapted to receive therein a cam disc 34 secured to a rotatable shaft terminating exteriorly of the portion 32 with a hand crank 37 adapted to be rotated manually. Positioned on either side of cam disc 34 are first and second inverted generally L-shaped members 36 and 38 respectively, adapted to be moved in response to rotation of the crank 37 to insert successive loops of yarn 40 through the fabric 26 as will hereinafter be discussed.

Figure 4:
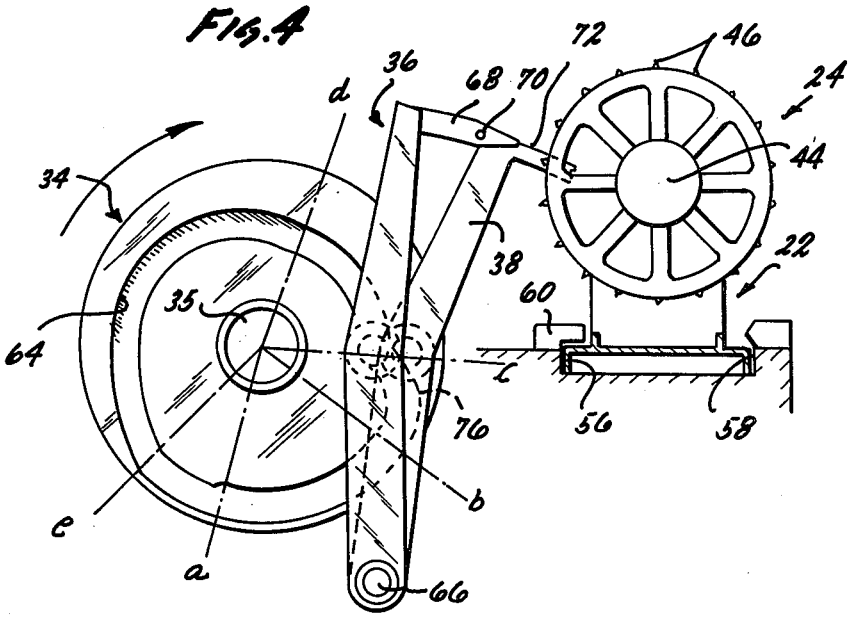
FIG. 4 is a diagramatic side view illustrating the operative relation between the main working components.

As best illustrated in FIGS. 2 and 4, the roller 24 is a generally open framework formed from a plurality of identical equally spaced discs 42 secured to a common shaft member 44 with the indexing wheels or handles 30 secured to the opposite ends of shaft 44. Each of the discs 42 is provided about the periphery thereof with radially extending prongs 46 adapted to engage the fabric in a fixed position on the roller 24.

Figure 3:
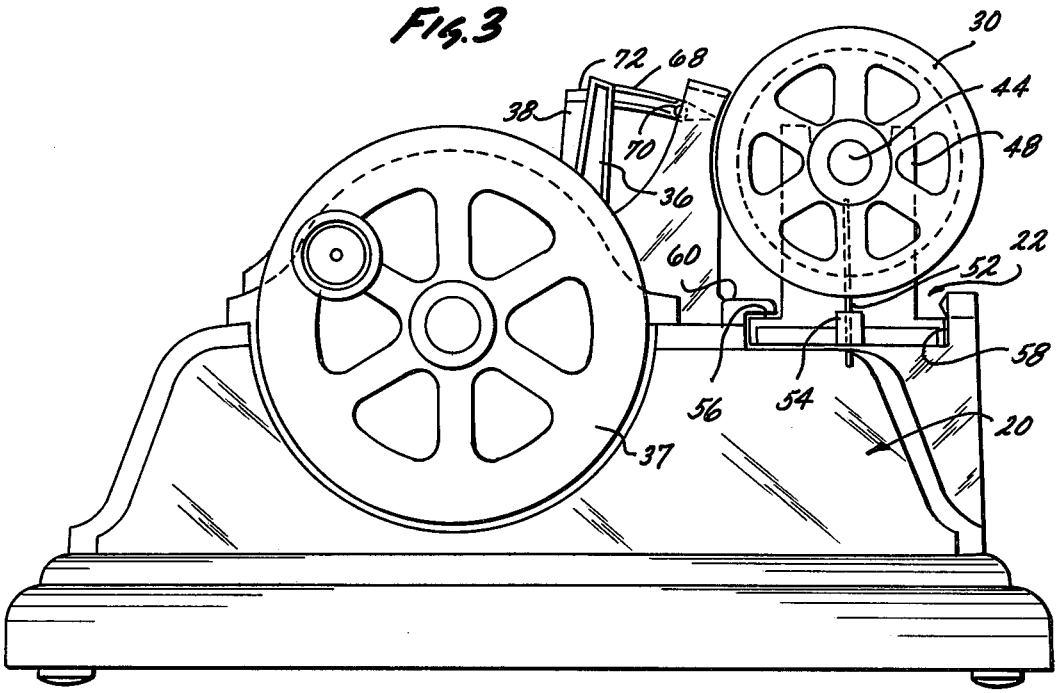
FIG. 3 is a side elevational view of the machine of FIG. 1.

The shaft 44 of roller 24 is rotatably received on carriage 22 within the upwardly extending trunnions 48 integrally formed with the carriage 22 at opposite ends thereof. Each of the wheels 30 is serrated about the periphery of an interior surface thereof to form the serrated indexing portion 50, the serrations extending in a direction parallel to the axis of shaft 44. As shown in FIG. 3, a wire spring member 52 has one end thereof secured to the housing 20 by means of a suitable projection 54, the spring 52 extending generally upwardly from the housing 20 to matingly resiliently coact with the serrated portion 50 of handles 30 to thereby permit indexable rotation of the roller 24 about the axis of shaft 44.

As illustrated in FIGS. 2 and 3, the carriage 22 is slidably retained on housing 20, as can be seen in FIGS. 2 and 3, by the flanged portion 56 of the carriage 22 being received in a recess 58 formed in the rear upper surface of housing 20, the upper edges of flange 56 being retained therein by half-bearings 60 formed integrally in the surface of housing 20 adjacent either side of recess 58. With the members 36 and 38 out of engagement with roller 24, the carriage 22 is freely slidable within the recess 58. Consequently, with the fabric 26 engaging the periphery of roller 24 with the radially extending prongs 46 extending through the mesh of fabric 26 with the horseshoe-shaped fabric retaining clips (see also FIG. 7) securing the opposite ends of fabric 26 to the roller 24, a mechanism is effected whereby the operator can position the fabric 26 along the direction of travel of carriage 22 at a desired location for receiving loops of yarn 40. With the wire spring 52 engaging a given notch in the serrated portion 50 of the indexing wheel or handle 30 a row of yarn 40 can be looped on a given line parallel to the axis of shaft 44 of roller 24.

Referring now to FIGS. 1 through 5, the details pertaining to the construction of the members 36 and 38 and the interrelationship thereof with camming disc 34 will be discussed. As indicated in dotted lines in FIG. 2, the handle 37 is secured to a shaft 35 which is likewise secured to camming disc 34 to provide rotation of camming disc 34 in response to rotation of handle 37. The camming disc 34 is a double-surfaced camming disc with opposing parallel surfaces having guideways therein for coacting with portions of members 36 and 38. As shown in FIGS. 4 and 5, one rotating surface of camming disc 34 coacting with the first member 36 had a guideway 64 formed therein, the guideway 64 being formed in camming disc 34 by providing generally parallel sidewalls extending perpendicular to the surface of camming disc 34. Both members 36 and 38 are pivotally secured within the housing 20 at a common axis 66 at the end of the long arms of each of members 36 and 38, the shaft 66 being positioned below the outer periphery of camming disc 34 and intermediate shaft 35 and carriage 22. The short arm of member 36 is the needle arm 68 having a pointed end at the free end thereof with an eye 70 extending therethrough adjacent the pointed end, the length of needle arm 68 being sufficient to permit yarn carried through eye 70 to pass through the fabric 26 into the space between adjacent discs 42 in the open framework structure of roller 24. As better illustrated in FIG. 5, in cross section the needle arm 68 is channel-shaped with the parallel sidewalls of the channel extending transversely to the surface of needle arm 68 toward the short arm or looping arm 72 of member 38. The looping arm 72 is offset from the long arm of member 38 toward needle arm 68 and configured to selectively slidably engage the channel formed in needle arm 68 during operation of the machine as will hereinafter be discussed. The free end of looping arm 72 is provided with a notch 74 which is so aligned with respect to eye 70 that with the members 36 and 38 pivoting in the arc indicated adjacent needle arm 68 and looping arm 72 respectively, the notch 74 releasably engages the cord passing through eye 70 of needle arm 68. Extending transversely to the surfaces of the long arms of members 36 and 38 at locations generally intermediate the long arms are opposing inwardly extending cam follower projections 76 and 78 respectively. The cam follower 76 of first member 36 is adapted to fit within cam guideway 64 on the adjacent surface of camming disc 34 whereby the position of the needle arm 68 with respect to the fabric 26 is determined by the particular section of guideway 64 coacting with cam follower 76.

As illustrated in FIG. 5, the opposing disc-shaped surface of camming disc 34 is provided with a guideway 80 formed of sidewalls extending perpendicular to the surface of camming disc 34. Unlike the guideway 64 coacting with the needle member 36, the guideway 80 along with other structure formed on the surface of camming disc 34 accomplishes camming in two directions, the first camming direction affecting the positioning of the looping arm 72 with respect to the surface of the fabric 26 and the second camming direction being the spacing between adjacent surfaces of looping arm 72 with respect to needle arm 68.

For purposes of discussion, the camming means on the surface of disc 34 has been segmented into portions designated by broken lines bearing reference designations "*a*"–"*e*", with the opposite cam surface having cam guideway 64 thereon being similarly designated to illustrate the phasing of opposing cam surfaces of camming disc 34. It is to be understood that while the designations "*a*"–"*e*" in FIG. 5 with respect to the cam surface coacting with the looping member 38 are disposed clockwise about disc 34, the corresponding positions for the opposing surface would be counterclockwise as shown in FIG. 4, but in any event, the portion of the cam guideway 64 at location "*a*" would correspond to the location of guideway 80 at the same point "*a*" on the opposite surface.

Prior to discussing the camming effect, the mounting of the members 36 and 38 is such that the apertures in the long arms thereof are slightly larger than the outer diameter of shaft 66 to provide a certain amount of play, this tolerance being compensated for by means of a first leaf spring 82 having the bent portion 84 thereof suitably secured within the housing 20, the spring 82 urging against the surface of member 36 adjacent cam follower projection 76 to maintain cam follower 76 in engagement within cam guideway 64. Similarly a second leaf spring 86 is secured by the bent portion 88 to the housing 20 so that the free end thereof urges against the long arm of looping member 38 to urge cam follower 78 into cam guideway 80. With reference to the coaction of the respective cam followers within the cam guideways, position "*a*" has been arbitrarily selected as a reference position and the following discussion with respect to the camming action will be directed toward the designated location being on a horizontal line at a point where the cam follower engages the respective guideway. Also for discussion purposes, the movement of the cam follower away from the shaft 35 of camming disc 34 will be referred to as extension (corresponding to extension into the fabric) and movement in the opposite direction will be referred to as withdrawal, this terminology being selected to describe the movement of the needle arm 68 and the looping arm 72 with respect to the fabric 26.

Figure 13:
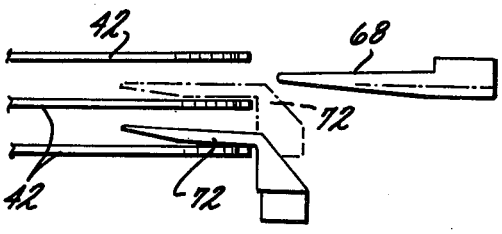
FIG. 13 is a fragmentary elevation taken along line 13–13 of FIG. 12 illustrating the lateral displacement of one of the members to increment the roller.

With the cam follower 78 at position "*a*" the looping arm 72 is at the maximum withdrawal position while the needle arm 68 is at maximum extension into the fabric 26 (see FIG. 10) with the looping arm 72 having the surface thereof abutting the surface of needle arm 68 within the channel. As the camming disc 34 rotates in the direction of the arrow to location "*b*" as can be seen in FIG. 4 the needle arm 68 remains at maximum extension while the looping arm 72 slides within the channel of needle arm 68 until the notch 74 of looping arm 72 engages the yarn passing through eye 70 of needle arm 68 (see FIG. 11). During rotation thereafter to location "*c*" the looping arm 72 remains in engagement within the fabric 26 at maximum extension while needle arm 68 proceeds to maximum withdrawal position as can be seen by the form of the guideway 64, the position of the members 36 and 38 at location "*c*" being depicted in FIG. 4. Referring again to FIG. 5 during the travel of cam follower 78 within guideway 80 between location "*a*" and "*c*", the opposing sidewalls forming that portion of guideway 80 are at a uniform minimum distance in height from the main surface of camming disc 34. During travel of the cam follower 78 from location "*c*" to "*d*" the cam follower 78 engages a ramp 90 which intercepts the center of the cam follower 78 to thereby displace it laterally (to the left as viewed in FIG. 5) with the looping arm 72 still maintaining maximum extension into the fabric 26 resulting in movement of the carriage 22 a distance determined by the shape of the ramp 90, which distance corresponds to the spacing between discs 42 on roller 24 to thereby position needle arm 68 for penetration of the fabric 26 in the space between adjacent discs 42, this action being illustrated in FIG. 13. As can be seen in FIG. 4 during the rotation from location "*c*" to "*d*", the needle member 36 remains in its maximum withdrawal position due to guideway 64 being at its closest position to shaft 35. This lateral movement of carriage 22 would also correspond to the stitch length of the yarn being inserted into the fabric 26.

As the respective cam followers traverse the camming disc 34 from locations "*d*" to "*e*" as shown in FIG. 5, the cam follower 78 can engage one of two portions of cam guideway 80, these portions being designated guideway 92 and guideway 94 respectively. During continuous rotation of camming disc 34 in the direction indicated by the arrow, the normal route that the cam follower 78 would take would be that defined by guideway 92. The opposing sidewalls forming guideway 92 are at a uniform height from the surface of camming disc 34, this height being generally the same as the elevation provided by ramp 90, as a consequence of which the looping arm 72 will remain spaced the incrementing distance from the coacting surface of the blade-shaped needle arm 68, and furthermore due to the guideway 92 being adjacent the outer periphery of camming disc 34 during this travel, the looping arm 72 will remain in its maximum extension position within fabric 26. Referring to FIG. 4 during this interval of travel from location "*d*" to "*e*" the cam follower 76 of needle member 36 moves from its maximum withdrawal position to its maximum extension position thereby inserting another loop of yarn through the fabric 26 in the space between discs 42, which space is one space to the right of the space now occupied by looping arm 72. At this point, looping arm 72 serves a dual function. Due to its engagement within the fabric 26, the yarn 40 is retained in notch 74 within the fabric 26 thereby frictionally retaining the so looped yarn 40 from movement thereby permitting the yarn to move with respect to the eye 70 of needle arm 68 during insertion of the needle arm 68 through fabric 26. Additionally, the engagement of looping arm 72 within the fabric 26 maintains the roller 24 in position to prevent movement thereof while the needle arm 68 is penetrating the fabric 26. As the cam follower 78 passes by location "*e*", the abutting edge of cam follower 78 engages a V-shaped guide member 96 which carries the cam follower 78 at the same distance from the surface of camming disc 34 until at point "*a*" the cam follower 78 drops within guideway 80 under the force of leaf spring 86 to thereby position looping arm 72 for sliding abutting relation within the channel of needle arm 68 as depicted in FIG. 1.

With respect to the alternate guideway 94 previously referred to, after the operator has completed a given row of stitching, at location "*d*" of camming disc 34 as previously discussed, the needle arm 68 is at maximum withdrawal position and by reversal of the direction of rotation of camming disc 34 by means of the handle 37 the cam follower 78 coacts with a second V-shaped guide 98 which maintains the spacing of looping arm 72 the stitch width distance from needle arm 68 but fully withdraws looping arm 72, thereby permitting the operator to cut the yarn 40, reposition the carriage 22 by sliding it to a predetermined position, to index the roller 24 by rotation of the indexing handles 30 and to change the yarn if desired. With the necessary adjustments made by the operator the camming disc 34 is then rotated in the proper direction indicated by the arrow with the result being that the cam follower 78 of the looping member 38 now follows guideway 94 which has opposing sidewalls thereof the same height as the sidewalls for guideway 92. Upon subsequent engagement of the cam follower 78 with the other V-shaped guide 96 the cam follower 78 then returns to the position previously discussed with respect to location "*a*" and the looping operation can then begin for the so selected row. The results of the needlepoint or carpet looping operation are shown in FIG. 6 wherein the fabric 26 has rows of yarn 40 retained therein.

Figure 8:
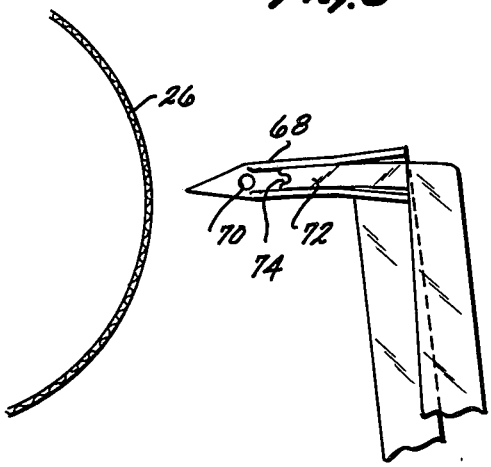
FIGS. 8–12 are fragmentary side elevations illustrating the sequence of operation of the first and second members to effect the looping of the yarn.

Referring to FIGS. 8–13, the sequence of operation will be discussed with reference to the positions of needle arm 68 and looping arm 72 with respect to each other and with respect to the fabric 26 suitably mounted on roller 24. In FIG. 8, the looping arm 72 is shown fully retracted and within the channel of needle arm 68 which, at this point, is stationary, this position corresponding to the position resulting when camming disc 34 is rotated in the reverse direction causing cam follower 78 associated with looping arm 72 being directed by V-shaped guide 98 to the apex of the "V". In this position the insertion of yarn 40 into the eye 70 can be accomplished or the adjustments of the fabric 26 previously discussed can be effected.

Figure 9:
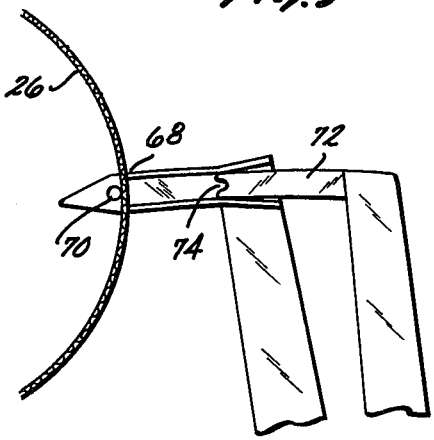
Figure 10:
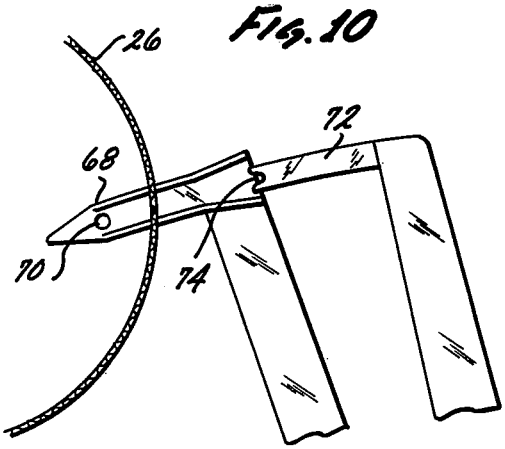
Figure 11:
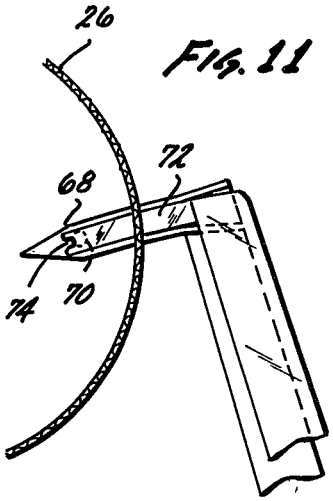
Figure 12:
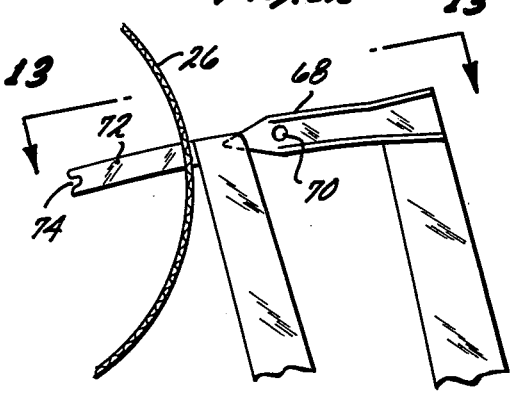

In FIG. 9 looping arm 72 is fully withdrawn and stationary while needle arm 68 carrying yarn 40 (not illustrated) penetrates the fabric 26 to insert the yarn therethrough. The needle arm 68 is tapered in two directions (see FIG. 5) to facilitate penetration of the fabric 26. In FIG. 10 the needle arm 68 has fully penetrated the fabric 26 with needle arm 68 being at maximum extension and at this point, looping arm 72 is beginning to move toward the fabric 26, this condition existing at location "*a*" of the camming disc 34. The looping arm 72 enters the channel of needle arm 68 in sliding abutting relation until the position of FIG. 11 is reached, this position corresponding to location "*b*" as previously discussed. At this point, it can be seen that the notch 74 passes slightly by the eye 70 of needle arm 68 thereby gripping the yarn to retain it within the fabric 26. With looping arm 72 remaining in engagement at maximum extension within the fabric 26, the needle arm 68 then withdraws to the position illustrated in FIG. 12, this situation existing at location "*c*" on camming disc 34. With looping arm 72 remaining at maximum extension with needle arm 68 at maximum withdrawal, referring to FIG. 13, the looping arm 72 then moves from the dotted line position to the solid line position indicated to thereby increment the carriage 22 by means of engagement of looping arm 72 with the adjacent surface of a disc 42, or alternatively by means of the engagement of the looping arm 72 with the fabric 26 secured about the periphery of disc 42. The solid line position of the parts depicted in FIG. 13 would correspond to location "*d*" on the camming disc 34. With the looping arm 72 remaining in the solid line position shown in FIG. 13 the needle arm 68 then travels to the left as viewed in FIG. 13, until the needle arm 68 again penetrates the fabric 26 thereby inserting the next loop of yarn through the material of fabric 26. This last mentioned operation would correspond to the location "*e*" of the camming disc 34. With the needle arm 68 remaining at maximum extension the looping arm 72 is then withdrawn until the location "*a*" is reached at which point, the position of the parts is as indicated in FIG. 10 with the sequences of FIGS. 10 through 13 being repeated along with, of course, the subsequent sequence of insertion of needle arm 68 with the subsequent step of withdrawal of looping arm 72.

The resulting needlepoint machine effectively laterally displaces the fabric 26 carried by a roller 24 a predetermined distance defining the stitch width of yarn insertions into the fabric 26, this stitch width being equal to the spacing between discs 42 forming roller 24. The needle of needle arm 68, as previously discussed, is blade-shaped and tapered in a first direction to form a point and in a second direction transverse thereto by means of the tapered channel sidewalls to facilitate insertion of the needle arm 68 into the fabric 26. This provides for some margin of error for the initial insertion of the needle arm 68 so that a child with limited manual dexterity can readily operate the machine. Subsequent incrementing of carriage 22 along with roller 24 is automatically effected by the double purpose cam means coacting with the looping arm 72. The operation of the machine is manual and simply effected by a hand crank adapted to be rotated in one direction, with a reverse direction position being provided for a set position wherein both arms are withdrawn a spaced distance from the fabric to permit suitable adjustments. The machine performs needlepoint or carpet looping functions to provide successive loops of a continuous strand of yarn to be inserted into a fabric to thereby permit a child of limited manual dexterity to enjoy the hobby of needlepoint or carpet looping. While there has been shown and described a preferred embodiment, it is to be understood that various other adaptations and modifications may be made within the spirit and scope of the invention.

What is claimed is:

1. In a machine for performing needlepoint or the like, the combination comprising:

a housing;

a generally open framework mounted on said housing for movement in a first direction, said framework being adapted to support a fabric thereon;

a first member pivotally mounted to said housing and having a needle arm means on said needle are for receiving cord-like material, said needle arm being configured to insert said cord-like material through said fabric;

a second member pivotally mounted to said housing and having an arm portion configured to selectively slidably engage a surface of said needle portion, the end of said arm portion being configured for inserting through said fabric to releasably engage said cord-like material;

phased cam means operatively coupled to said first and second members for permitting insertion of said needle arm through said fabric, retention of the cord-like material by said arm portion during withdrawal of said needle arm and incrementing of said framework by said arm portion; and means for moving said cam means.

2. The combination according to claim 1 wherein said needle arm is generally blade-shaped with a channel formed in a portion of the surface thereof and said arm portion of said second member is configured for selective sliding engagement within said channel.

3. The combination according to claim 2 wherein said needle arm has an eye adjacent the point thereof for receiving the cord-like material therethrough and said arm portion has a notch at the end thereof adapted to operate in alignment with said eye, said notch releasably engaging said cord-like material within said fabric during withdrawal of said needle arm whereby to create the loops.

4. The combination according to claim 3 wherein each of said first and second members is pivoted about a common axis.

5. The combination according to claim 4 wherein each of said first and second members has a long arm having one end thereof pivoted on said pivot axis, said needle arm extends transverse to the long arm of said first member and said arm portion extends transverse to the long arm of said second member.

6. The combination according to claim 1 wherein said cam means is a rotatable cam disc having cam guideways formed in opposing surfaces thereof and said first and second members are pivotally mounted on a common axis adjacent opposite surfaces of said cam disc, said first and second members having cam follower portions for engaging the adjacent cam guideway.

7. The combination according to claim 6 wherein said cam disc is secured to a shaft and said means for rotating said cam means is a hand crank secured to said shaft.

8. In a machine for performing needlepoint or the like, the combination comprising:

a housing;

a carriage slidably mounted for movement on said housing in a first direction;

an indexable roller mounted on said carriage, said roller having a generally open periphery and being adapted to support a fabric thereon;

a first member pivotally mounted within said housing and having a needle arm movable in a direction transverse to said first direction for inserting cord-like material through said fabric;

a second member pivotally mounted within said housing and having an arm portion extending generally parallel to said needle arm for selectively slidably engaging the adjacent surface of said needle arm and configured for insertion through said fabric for releasably receiving said cord-like material;

phased rotatable cam means operatively coupled to said first and second members, said cam means being configured to sequentially (a) insert said needle arm and the cord-like material carried thereby through said fabric, (b) insert said arm portion through said mesh in sliding relation with said needle arm, (c) withdraw said needle arm, (d) move said arm portion in said first direction to increment said carriage, (e) insert said needle arm through said fabric, and (f) withdraw said arm portion; and means for rotating said cam means.

9. The combination according to claim 8 wherein said phased cam means is a cam disc having cam guideways on opposing surfaces thereof.

10. The combination according to claim 9 wherein said first and second members are pivoted about a common axis, each of said members having a cam follower portion extending into the respective cam guideway.

11. The combination according to claim 10 including means spring biasing each of said members toward said cam disc.

12. The combination according to claim 11 wherein the cam guideway on the side of said cam disc coacting with said second member has a cam surface formed within said cam guideway to selectively move said second member in said first direction whereby to increment said carriage.

13. The combination according to claim 12 wherein said cam disc is rotatably secured within said housing to a shaft, said shaft having a manually operable crank on one end thereof externally of said housing.

14. The combination according to claim 13 wherein said needle arm has an eye adjacent the needle end thereof.

15. The combination according to claim 14 wherein said needle arm is arcuately formed in a direction circumferential to the pivot of said first member and has guide means on a surface thereof extending toward said second member, said guide means being adapted for slidably receiving said arm portion therein.

16. The combination according to claim 15 wherein said arm portion has the free end thereof notched to engage the cord-like material passing through the eye of said needle arm.

17. The combination according to claim 16 wherein the guide means on the surface of said needle arm is a channel formed in a part of the surface of said needle arm.

18. The combination according to claim 17 wherein said needle arm is generally blade-shaped, said arm portion is blade-shaped and configured to fit within said channel.

* * * * *